US009390703B2

(12) United States Patent
Yamakawa et al.

(10) Patent No.: US 9,390,703 B2
(45) Date of Patent: Jul. 12, 2016

(54) MASKING SOUND GENERATING APPARATUS, STORAGE MEDIUM STORED WITH MASKING SOUND SIGNAL, MASKING SOUND REPRODUCING APPARATUS, AND PROGRAM

(75) Inventors: Takashi Yamakawa, Iwata (JP); Mai Koike, Hamamatsu (JP); Masato Hata, Hamamatsu (JP); Yasushi Shimizu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 270 days.

(21) Appl. No.: 13/989,775

(22) PCT Filed: Nov. 25, 2011

(86) PCT No.: PCT/JP2011/077222

§ 371 (c)(1),
(2), (4) Date: Aug. 14, 2013

(87) PCT Pub. No.: WO2012/070655

PCT Pub. Date: May 31, 2012

(65) Prior Publication Data

US 2013/0315413 A1 Nov. 28, 2013

(30) Foreign Application Priority Data

Nov. 25, 2010 (JP) ..... 2010-262250
Mar. 2, 2011 (JP) ..... 2011-044873
Nov. 18, 2011 (JP) ..... 2011-252833

(51) Int. Cl.
*G10K 11/175* (2006.01)
*H04K 3/00* (2006.01)

(52) U.S. Cl.
CPC ..... *G10K 11/175* (2013.01); *H04K 3/825* (2013.01); *H04K 2203/12* (2013.01)

(58) Field of Classification Search
CPC ..... H04R 25/75; G10K 11/175; G10K 11/178
USPC ..... 381/73.1
See application file for complete search history.

(56) References Cited

U.S. PATENT DOCUMENTS 7,272,718 B1 * 9/2007 Matsumura ..... G10L 19/018 380/217
2004/0019479 A1 1/2004 Hillis et al.

(Continued)

FOREIGN PATENT DOCUMENTS

JP 2006-243178 A 9/2006
JP 2008-090296 A 4/2008

(Continued)

OTHER PUBLICATIONS

Notification of Reasons for Refusal dated Jan. 12, 2016, for JP Patent Application No. 2011-252833, with English translation, ten pages.

*Primary Examiner* — Duc Nguyen
*Assistant Examiner* — George Monikang
(74) *Attorney, Agent, or Firm* — Morrison & Foerster LLP

(57) ABSTRACT

Whereas a high masking effect can be secured in a space to which a masking sound is emitted, the degree of a discomfort a person existing in the space suffers can be reduced. In superimposition processing, a CPU 21 extracts sound signals in different intervals of a sound signal $X_{12}$-n of a human voice, superimposes the extracted sound signals on each other on the time axis, and outputs a resulting superimposed sound signal $X_{13}$-n. In shift and addition processing, the CPU 12 interchanges a sound signal, before a reference position, of a sound signal $X_{16}$-n and a sound signal, after the reference position, of the sound signal $X_{16}$-n (shift processing) and outputs a sound signal $X_{17}$-n obtained by adding together a shift-processed sound signal $X_{16}$'-n and the original, non-shift-processed sound signal $X_{16}$-n.

16 Claims, 8 Drawing Sheets

(56) References Cited

U.S. PATENT DOCUMENTS

| | | | |
|---|---|---|---|
| 2006/0241939 | A1 | 10/2006 | Hillis et al. |
| 2006/0247924 | A1 | 11/2006 | Hillis et al. |
| 2008/0235008 | A1 | 9/2008 | Ito et al. |
| 2008/0243492 | A1 | 10/2008 | Miki et al. |
| 2008/0281588 | A1 | 11/2008 | Akagi et al. |
| 2012/0016665 | A1 | 1/2012 | Ito et al. |

FOREIGN PATENT DOCUMENTS

| | | | |
|---|---|---|---|
| JP | 2008-107706 | A | 5/2008 |
| JP | 2008-209785 | A | 9/2008 |
| JP | 2008-233671 | A | 10/2008 |
| JP | 4324104 | B2 | 6/2009 |

* cited by examiner

MASKING SOUND GENERATING APPARATUS, STORAGE MEDIUM STORED WITH MASKING SOUND SIGNAL, MASKING SOUND REPRODUCING APPARATUS, AND PROGRAM

CROSS-REFERENCE TO RELATED APPLICATIONS

This application is a National Phase application under 35 U.S.C. §371 of International Application No. PCT/JP2011/077222 filed Nov. 25, 2011, which claims priority benefit of Japanese Patent Application No. 2010-262250 filed Nov. 25, 2010, Japanese Patent Application No. 2011-044873 filed Mar. 2, 2011, and Japanese Patent Application No. 2011-252833 filed Nov. 18, 2011. The contents of the above applications are herein incorporated by reference in their entirety for all intended purposes.

TECHNICAL FIELD

The present invention relates to a technique for preventing a leak sound from being heard by generating a masking sound.

BACKGROUND ART

Various techniques for preventing a leak sound from being heard utilizing a masking effect have been proposed. The masking effect is a phenomenon that when two kinds of sounds travel through the same space, one sound (masking sound) serves as an obstacle to hearing of the other sound (target sound) by a listener in the space. Many of the techniques of this kind are such that a masking sound is emitted toward a space that is adjacent to, via a wall or a screen, a space where a speaker as a source of a target sound exists.

Patent document 1 discloses a technique of generating a masking sound for preventing a human voice as a target sound from being heard by processing its sound waveform. In a masking method disclosed in the same document, a sound signal representing a human voice is divided into plural segments in intervals each of which corresponds to one phoneme. A sound signal obtained by rearranging the positions of the plural divisional segments randomly is reproduced as a masking sound. The meaning of a sound obtained by the technique cannot be understood though it seems like a human voice. The use, as a masking sound, of such a sound can provide a higher masking effect than in the case of using a sound having a wide spectrum such as an environment sound.

PRIOR ART DOCUMENTS

Patent Documents

Patent document 1: JP-B-4324104
Patent document 2: JP-A-2008-107706

SUMMARY OF THE INVENTION

Problems to be Solved by the Invention

However, a sound that is obtained from a human voice by randomly rearranging phonemes of a human voice in units of an interval corresponding to one phoneme is, in itself, causes an unfamiliar auditory sensation. Therefore, there is a problem that a masking sound produced from a sound signal generated by the technique disclosed in Patent document 1 causes a listener existing in a space to feel uncomfortable.

An object of the present invention is to reduce the degree of a discomfort a person existing in a space suffers while securing a high masking effect in the space.

Means for Solving the Problems

The invention provides a masking sound generating apparatus comprising an acquiring unit that acquires a sound signal sequence which represents a voice; and a generating unit that includes a superimposing unit which extracts plural sound signal sequences in different intervals of the sound signal sequence and superimposes the extracted sound signal sequences on each other on the time axis, wherein the generating unit generates a masking sound signal from a sound signal sequence obtained through acquirement by the acquiring unit and processing by the superimposing unit. In this invention, a sound signal sequence obtained by the processing by the superimposing unit is such as to be obtained by superimposing on each other sound signal sequences in different intervals of an original sound signal sequence. Although the sound signal sequence is, as a whole, a disturbed version of the original sound signal sequence, the order of phonemes in each of the different intervals remains the same as in the original sound signal sequence. Therefore, a masking sound obtained by this invention does not cause a listener to feel uncomfortable while being able to provide the same level of masking effect as a masking sound that is obtained by randomly rearranging a sound signal representing a human voice in units of an interval corresponding to one phoneme. As such, the invention makes it possible to reduce the degree of a discomfort a person existing in a space suffers while securing a high masking effect in the space.

In one preferable mode, the superimposing unit includes a shifting and adding unit that performs shift processing which is processing of interchanging a sound signal sequence before a reference position in a processing subject sound signal sequence and a sound signal sequence after the reference position in the processing subject sound signal sequence, and outputs a sound signal sequence obtained by adding together a shift-processed sound signal sequence and the original, non-shift-processed sound signal sequence. A masking sound obtained by this mode likewise does not cause a listener to feel uncomfortable while being able to provide the same level of masking effect as a masking sound that is obtained by randomly rearranging a sound signal representing a human voice in units of an interval corresponding to one phoneme. As such, this mode makes it possible to reduce the degree of a discomfort a person existing in a space suffers while securing a high masking effect in the space.

In another preferable mode, the superimposing unit includes a shifting and adding unit that performs plural pieces of shift processing which are pieces of processing of interchanging sound signal sequences before different reference positions in a processing subject sound signal sequence and sound signal sequences after the reference positions in the processing subject sound signal sequence, respectively, and outputs a sound signal sequence obtained by adding together plural sound signal sequences obtained by the plural pieces of shift processing. In this case, since the plural shifting unit performs shift processing using different reference positions, the number of phonemes contained in a masking sound signal in a prescribed time can be increased and hence a masking sound can be generated in such a manner that a source sound signal is disturbed to a larger extent.

In another preferable mode, the superimposing unit includes a dividing and adding unit that divides, on the time axis, a processing subject sound signal sequence into sound signal sequences having shorter time lengths and adds together the divided sound signal sequences, and outputs a sound signal sequence obtained through pieces of processing by the dividing and adding unit and the shifting and adding unit. A masking sound obtained by this mode likewise does not cause a listener to feel uncomfortable while being able to provide the same level of masking effect as a masking sound that is obtained by randomly rearranging a sound signal representing a human voice in units of an interval corresponding to one phoneme. As such, this mode makes it possible to reduce the degree of a discomfort a person existing in a space suffers while securing a high masking effect in the space.

In still another preferable mode, the superimposing unit includes a dividing and adding unit that divides, on the time axis, a processing subject sound signal sequence into sound signal sequences having shorter time lengths and adding together the divided sound signal sequences; plural shifting units that perform pieces of shift processing which are pieces of processing of interchanging sound signal sequences before different reference positions in a sound signal sequence obtained through processing by the dividing and adding unit and sound signal sequences after the reference positions in the sound signal sequence, respectively; and an adding unit that adds together sound signal sequences obtained through pieces of processing by the plural shifting unit. This mode makes it possible to further increase the number of phonemes contained in a masking sound signal in a prescribed time.

In another preferable mode, the making sound generating apparatus includes a unit for skipping processing by the dividing and adding unit. For example, when the duration of a sound signal to be used for generation of a masking sound signal is short, it is preferable to use this unit to skip processing by the dividing and adding unit. This is because the processing by the dividing and adding unit shortens the time length of a sound signal sequence while having the effect of increasing the number of phonemes contained in a sound signal sequence in a prescribed time.

In a further preferable mode, the superimposing unit includes plural shifting units that performs pieces of shift processing which are pieces of processing of interchanging sound signal sequences before different reference positions in processing subject sound signal sequences and sound signal sequences after the reference positions in the processing subject sound signal sequences, respectively; plural reversing units that reverse, on the time axis, the arrangement order of a sound signal sequence in each of plural intervals of division of each of processing subject sound signal sequences obtained through pieces of processing by the plural shifting unit, and generates arrangement-order-reversed sound signal sequences; and an adding unit that adds together sound signal sequences obtained through pieces of processing by the plural reversing units. In this case, it is preferable that the plural reversing units reverse the arrangement order of the sound signal sequence in each interval on the time axis in such a manner that the sets of boundaries between the plural intervals of the sound signal sequences are set different from each other. This mode makes it possible to generate a masking sound in such a manner that a source sound signal is disturbed to an even larger extent.

MODE FOR CARRYING OUT THE INVENTION

Embodiments of the present invention will be hereinafter described with reference to the drawings.

Embodiment 1

Figure 1:
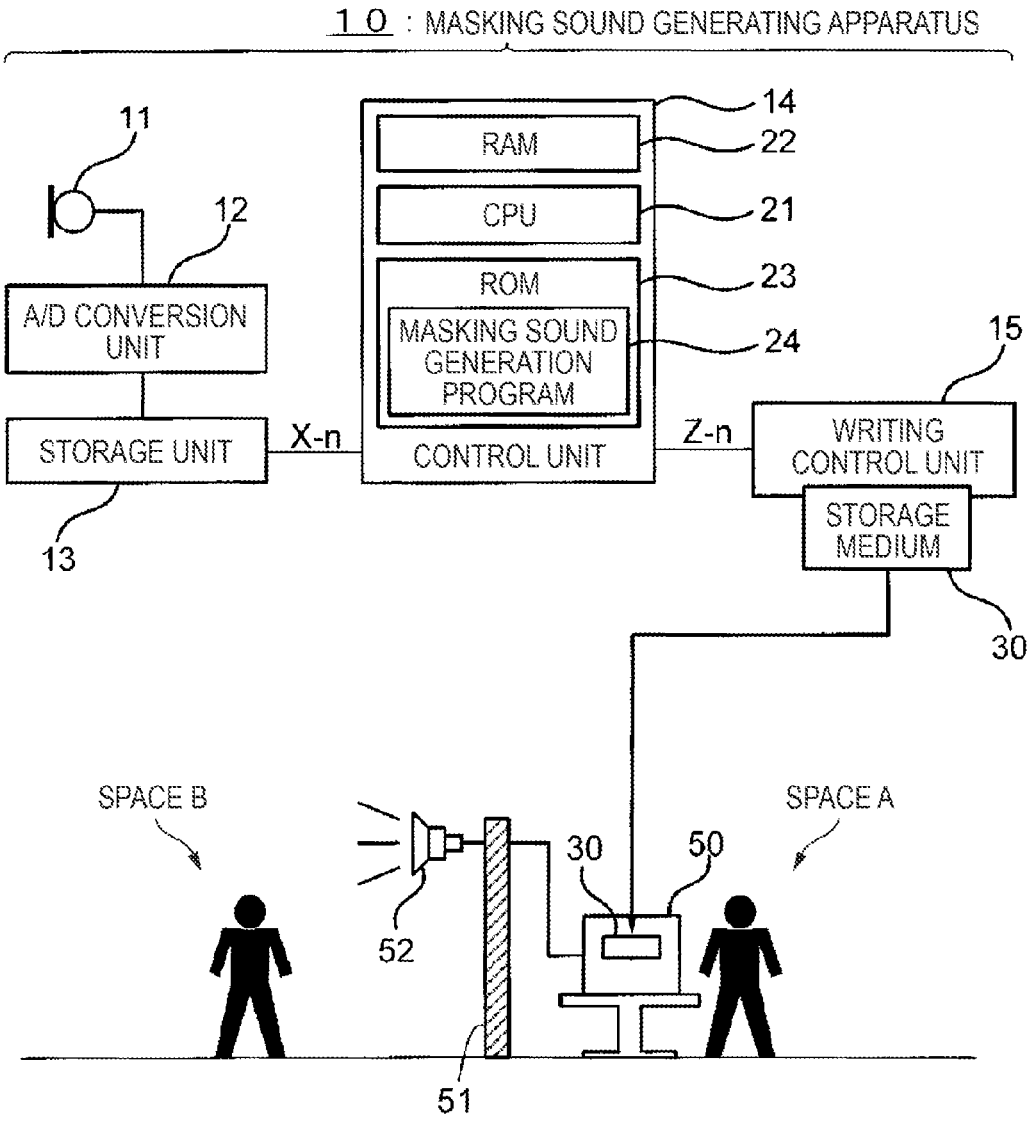
FIG. 1 is a block diagram showing the configuration of a masking system which includes a masking sound generating apparatus according to one embodiment of the present invention.

FIG. 1 shows the configuration of a masking system which includes a masking sound generating apparatus 10 according to a first embodiment of the invention. The masking sound generating apparatus 10 is an apparatus of generating sound signals Z-n (n=1 to N; N: natural number that is larger than or equal to 1) of masking sounds having a time length T4 (e.g., 1 min) from N kinds of sound signals X-n (n=1 to N) representing reading sounds obtained by causing N readers having various voice features to read around, for a time length T1 (e.g., 2 min; T1>T4), a writing which contains various phonemes (consonants and vowels), and storing the generated sound signals Z-n (n=1 to N) in a storage medium 30. A masking sound reproducing apparatus 50 is an apparatus of selecting and reproducing one of the N kinds of sound signals Z-n (n=1 to N) stored in the storage medium 30 and causing a speaker 52 to emit a reproduction sound toward one (in the example of FIG. 1, space B) of spaces A and B that are adjacent to each other with a screen 51 interposed in between, when the storage medium 30 which is stored with the sound signals Z-n (n=1 to N) is inserted into the masking sound reproducing apparatus 50.

A microphone 11 of the masking sound generating apparatus 10 picks up a reading sound and outputs an analog signal representing its waveform. An A/D conversion unit 12 converts the analog signal that is output from the microphone 11 from a start of the reading of a writing to its end into a digital sound signal X-n, and stores the resulting sound signal X-n in a storage unit 13. A control unit 14 acquires N kinds of sound signals X-n (n=1 to N) stored in the storage unit 13 one by one, generates a sound signal Z-n of a masking sound having the time length T4 from the acquired sound signal X-n, and outputs the generated sound signal Z-n to a writing control unit 15. The configuration of the control unit 14 will be described below in detail. The writing control unit 15 stores the sound signal Z-n supplied from the control unit 14 and identification information In specific to it in the storage medium 30.

Next, the configuration of the control unit 14 will be described in detail. The control unit 14 has a CPU 21, a RAM 22, and a ROM 23. The CPU 21 runs a masking sound generation program 24 stored in the ROM 23 while using the RAM 22 as a work area. The masking sound generation program 24 is a program which gives the following two functions to the CPU 21.

a1. Acquisition Function

This is a function of acquiring, from the storage unit 13, each of the sound signals X-n (n=1 to N) stored therein.

a2. Generation Function

This is a function of generating a sound signal Z-n of a masking sound from each sound signal X-n acquired from the storage unit 13 and outputting the generated sound signal Z-n to the writing control unit 15.

Figure 2:
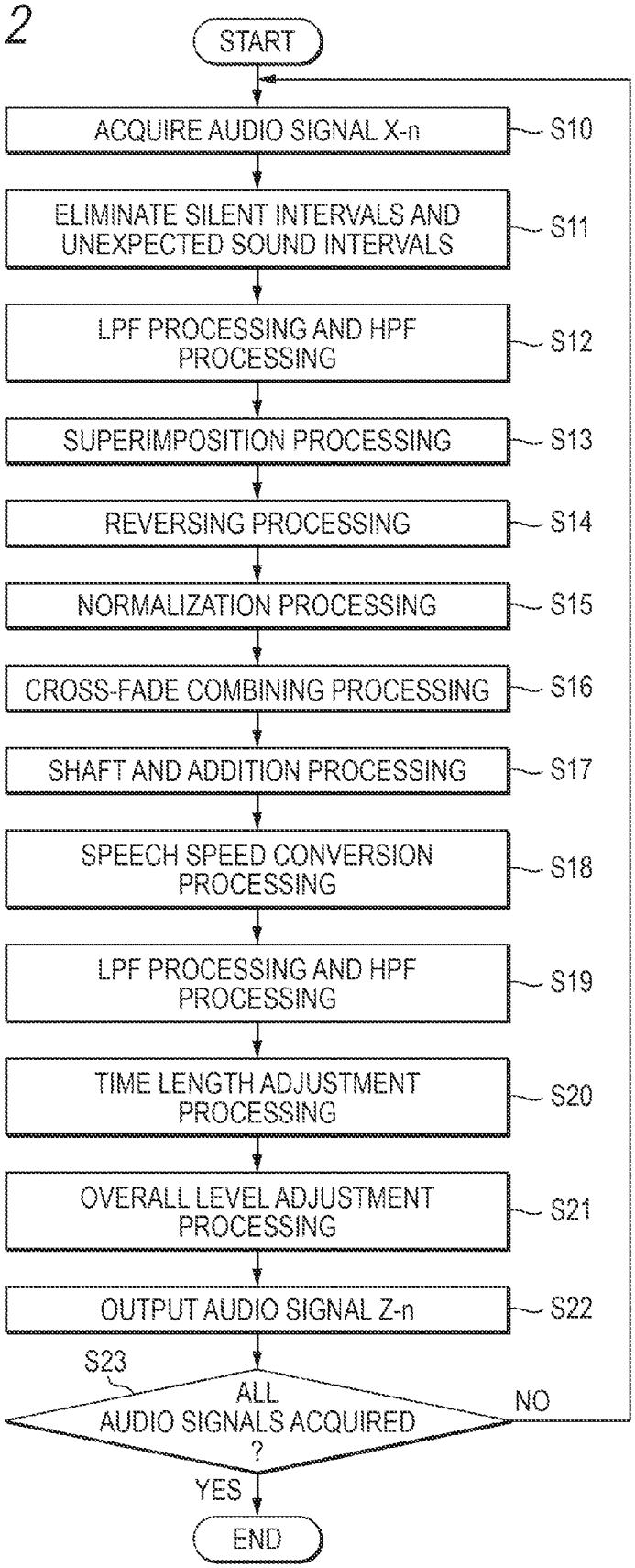
FIG. 2 is a flowchart showing how the masking sound generating apparatus operates.

Next, an operation of the embodiment will be described. FIG. 2 is a flowchart showing the operation of the embodiment. Step S10 shown in FIG. 2 is a step that is executed by the CPU 21 using the above-described acquisition function. Steps S11-S23 are steps that are executed by the CPU 21 using the above-described generation function. First, the CPU 21 acquires one sound signal X-n of N kinds of sound signals X-n (n=1 to N) stored in the storage unit 13 and stores it in the RAM 22 (S10).

Figure 3:
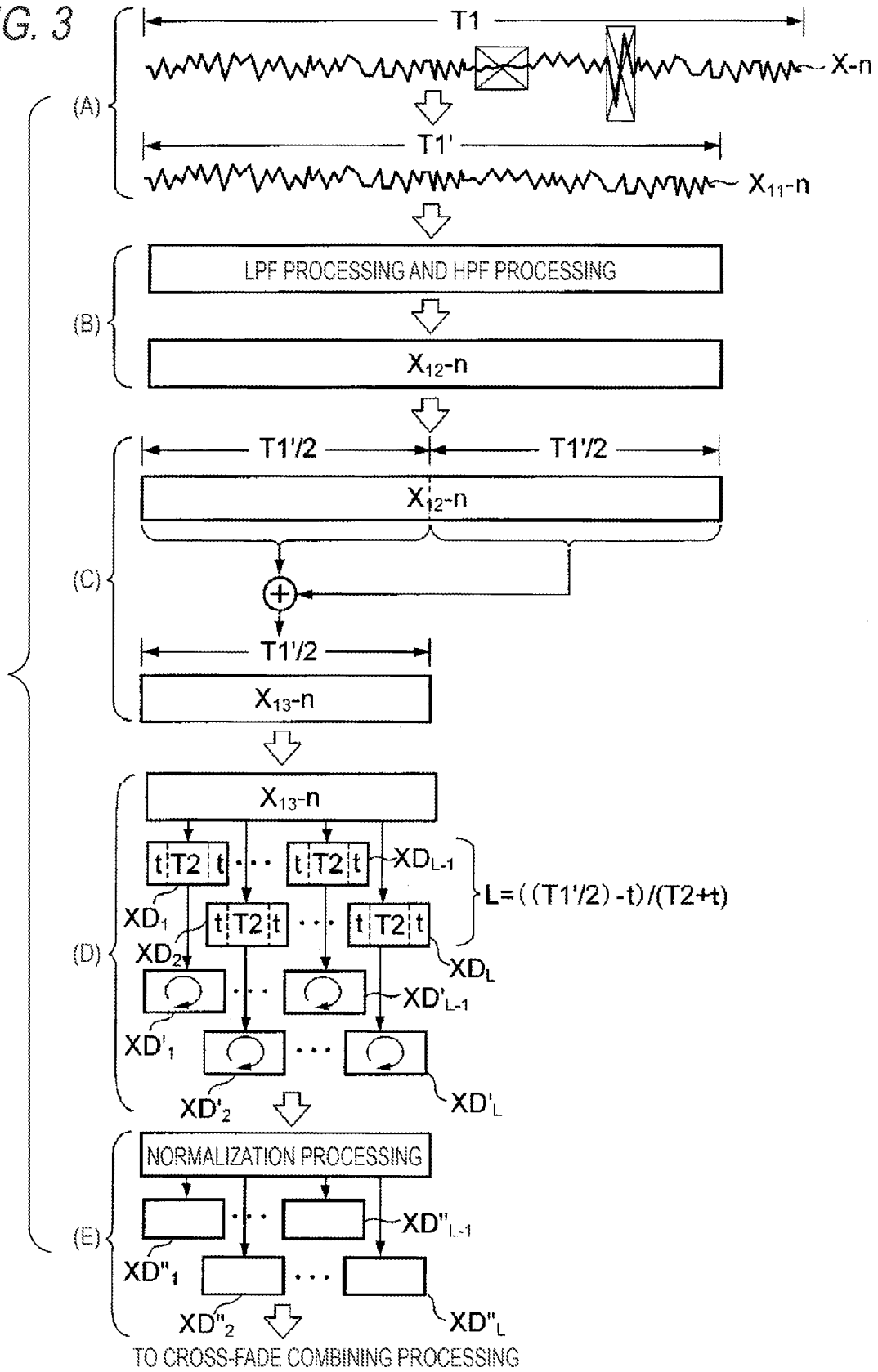
FIG. 3 illustrates how a sound signal is processed by the masking sound generating apparatus.

Then, as shown in FIG. 3(A), the CPU 21 eliminates sound signals in silent intervals and sound signals in unexpected sound intervals and generates a sound signal $X_{11}$-n having a time length T1' (T1'<T1) which is a connection of remaining intervals (S11).

Then, as shown in FIG. 3(B), the CPU 21 performs LPF (lowpass filter) processing of attenuating the sound signal X-n in a band that is higher than or equal to an upper limit frequency fc1 (e.g., 3,400 Hz) of a voice band and HPF (highpass filter) processing of attenuating the sound signal X-n in a band that is lower than or equal to a lower limit frequency fc2 (e.g., 100 Hz) of the voice band, and employs a processing result as a sound signal $X_{12}$-n (S12).

Then, as shown in FIG. 3(C), the CPU 21 performs superimposition processing on the sound signal $X_{12}$-n (S13). The superimposition processing is processing of extracting sound signals in different intervals of the sound signal $X_{12}$-n, superimposing the extracted sound signals on each other on the time axis, and outputting a resulting superimposed sound signal. More specifically, in the superimposition processing, the CPU 21 extracts a first-half sound signal having a time length T1'/2 and a second-half sound signal having a time length T1'/2 from the sound signal $X_{12}$-n having the time length T1' which is stored in the RAM 22. Then, the CPU 21 superimposes the first-half sound signal and the second-half sound signal on each other with their head positions and tail positions set so as to coincide with each other, and employs a resulting sound signal having the time length T1'/2 as a superimposition processing result (sound signal $X_{13}$-n).

Then, as shown in FIG. 3(D), the CPU 21 performs reversing processing (S14). The reversing processing is processing of dividing the sound signal $X_{13}$-n (superimposition processing result) into sound signals in L intervals $D_i$ (i=1 to L) having a fixed length in such a manner that adjoining intervals overlap with each other by a time t (e.g., 100 ms), and reversing the arrangement order of the sound signal in each interval $D_i$ on the time axis. The number L is equal to (T1'/2−t)/(T2+t) where T2 is equal to 500 ms, for example.

More specifically, in the reversing processing, the CPU 21 cuts out a sound signal $XD_1$ in a first interval $D_1$ whose start point is the start point of the sound signal $X_{13}$-n having the time length T1'/2 which is stored in the RAM 22 and end point is a point that is later than the start point by a time 2t+T2. Then, the CPU 21 cuts out a sound signal $XD_2$ in a second interval $D_2$ whose start point is a point that is later than the start point of the sound signal $X_{13}$-n by a time t+T2 (i.e., earlier than the end point of the first interval $D_1$ by a time t) and end point is a point that is later than the start point by the time 2t+T2. Subsequently, likewise, the CPU 21 cuts out a sound signal $XD_3$ in a third interval $D_3$, a sound signal $XD_4$ in a fourth interval $D_4$, . . . , a sound signal $XD_{L-1}$ in an (L−1)th interval and a sound signal $XD_L$ in an Lth interval $D_L$ in order. Then, the CPU 21 reverses the arrangement order of the sound signal $XD_i$ in each interval $D_i$ on the time axis, and employs L arrangement-order-reversed sound signals $XD'_i$ (i=1 to L) as processing subjects of normalization processing to be performed next.

As shown in FIG. 3(E), the CPU 21 performs the normalization processing (S15). The normalization processing is processing of making the sound volume temporal variations of the sound signals $XD'_i$ (i=1 to L) which are the processing results of the reversing processing fall within a prescribed range. More specifically, in the normalization processing, the CPU 21 calculates an effective value RMSA of all of the sound signals $XD'_i$ (i=1 to L) in the first to Lth intervals $D_i$ (i=1 to L) which are stored in the RAM 22 and individual effective values $RMSD_i$ in the respective intervals $D_i$. Then, the CPU 21 employs, as a correction coefficient $S_i$ of each interval $D_i$, the quotient of the effective value RMSA divided by the effective values $RMSD_i$ of the interval $D_i$, and multiplies the sound signal $XD'_i$ in each interval $D_i$ by the correction coefficient $S_i$. Then, the CPU 21 employs, as processing subjects of cross-fade combining processing to be performed next, L sound signals $XD''_i$ (i=1 to L) obtained by the multiplication by the correction coefficients $S_i$ (i=1 to L).

Figure 4:
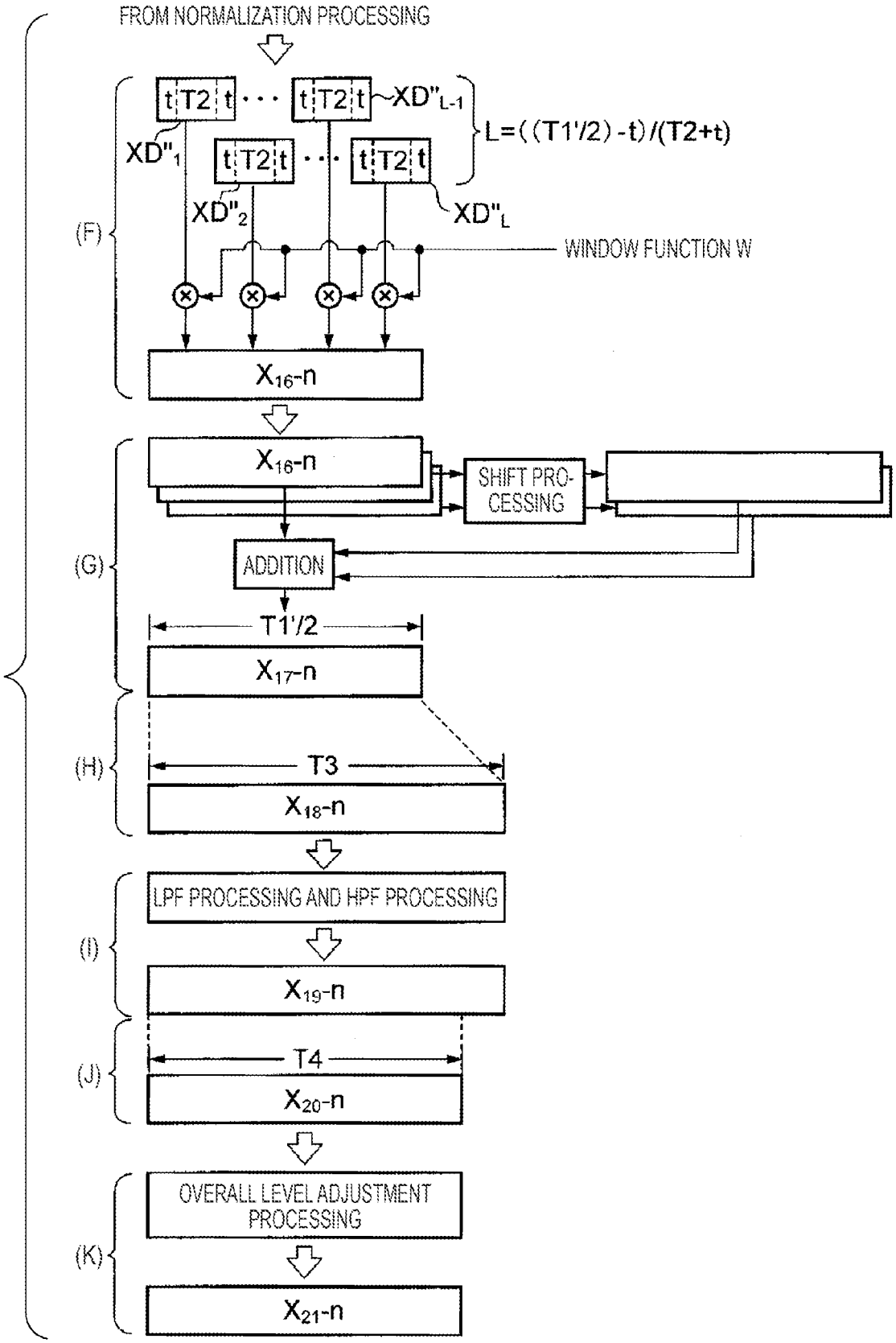
FIG. 4 illustrates how a sound signal is processed by the masking sound generating apparatus.

Then, as shown in FIG. 4(F), the CPU 21 performs the cross-fade combining processing (S16). The cross-fade combining processing is processing of recombining the L sound signals $XD''_i$ (i=1 to L) which are the processing results of the normalization processing in such a manner that the boundaries of adjoining ones are connected smoothly. More specifically, in the cross-fade combining processing, the CPU 21 multiplies each of the L sound signals $XD''_i$ (i=1 to L) stored in the RAM 22 by a window function W. The window function W serves to smoothly combine each sound signal $XD''_i$ with the sound signals in the immediately preceding and succeeding intervals by attenuating its start-point-side portion and end-point-side portion gently. After multiplying each of the sound signals $XD''_i$ (i=1 to L) by the window function W, the CPU 21 combines a sound signal $XD''_i \times W$ in each interval $D_i$ which is a result of the multiplication of the sound signal $XD''_i$ and the window function W with the sound signals in the immediately preceding and succeeding intervals with an overlap of the time t. The CPU 21 employs the thus-combined sound signal having the time length T1'/2 as a processing result of the cross-fade combining processing (sound signal $X_{16}$-n).

Then, as shown in FIG. 4(G), the CPU 21 performs shift and addition processing (S17). The shift and addition processing is processing of interchanging a sound signal, before a reference position, of the sound signal $X_{16}$-n (the processing result of the cross-fade combining processing) and a sound signal, after the reference position, of the sound signal $X_{16}$-n (shift processing) and then adding together a shift-processed sound signal and the original, non-shift-processed sound signal $X_{16}$-n.

Figure 5:
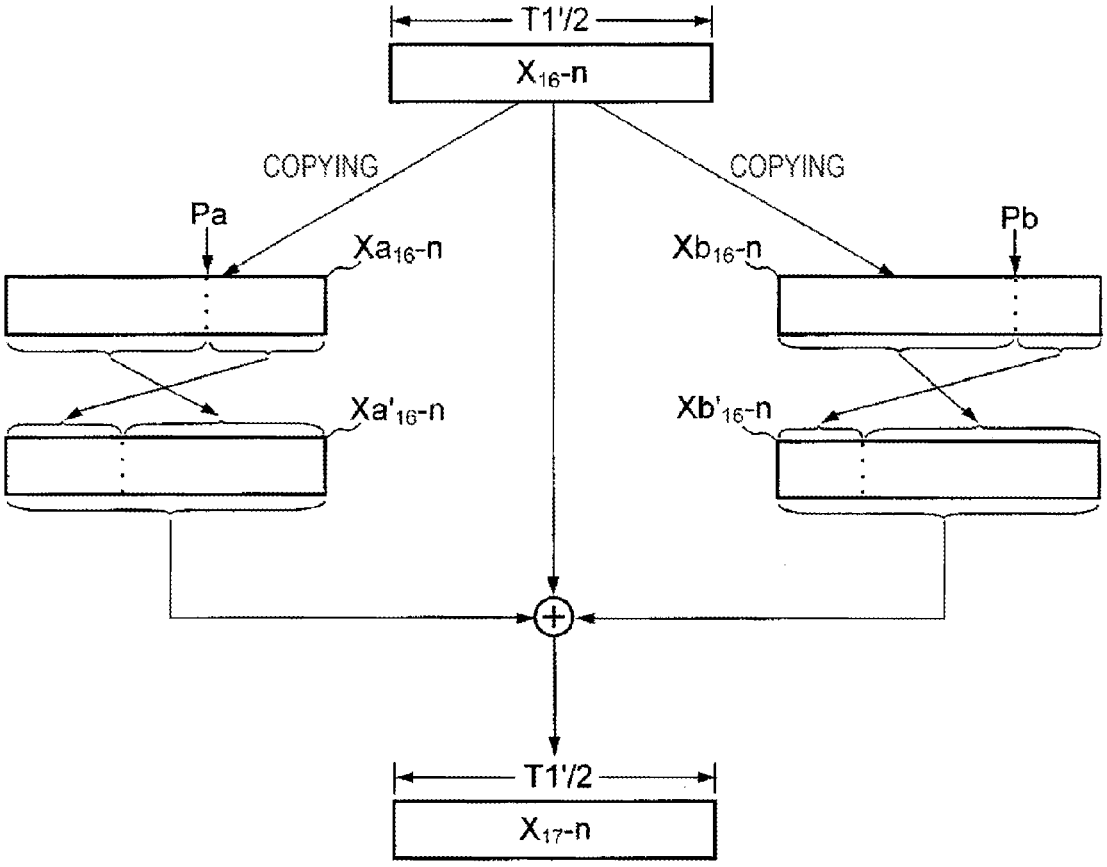
FIG. 5 illustrates the details of shift and addition processing which is performed by the masking sound generating apparatus.

More specifically, as shown in FIG. 5, the CPU 21 generates M (e.g., 2) copies of the sound signal $X_{16}$-n having the time length T1'/2 which is stored in the RAM 22, that is, generates M (M=2) sound signals $Xa_{16}$-n and $Xb_{16}$-n. The CPU 21 selects a reference position Pa from the sample data, arranged from the start point to the end point, of the sound signal $Xa_m$-n. The CPU 21 shifts sample data, from the start point to the reference position Pa, of the sound signal $Xa_{16}$-n rearward, places sample data, from the reference position Pa to the end point, of the sound signal $Xa_{16}$-n before the rearward-shifted sample data, and connects the two sets of sample data, to produce a sound signal $Xa_{16}'$-n.

Furthermore, the CPU 21 selects a reference position Pb which is different from the reference position Pa from the sample data, arranged from the start point to the end point, of the sound signal $Xb_{16}$-n. The CPU 21 shifts sample data, from the start point to the reference position Pb, of the sound signal $Xb_{16}$-n rearward, places sample data, from the reference position Pb to the end point, of the sound signal $Xb_{16}$-n before the rearward-shifted sample data, and connects the two sets of sample data, to produce a sound signal $Xb_{16}'$-n. Then, the CPU 21 adds together the sound signals $X_{16}$-n, $Xa_{16}'$-n, and $Xb_{16}'$-n with their start positions and end positions set so as to coincide with each other, and employs an addition result as a processing result of the shift and addition processing (sound signal $X_{17}$-n).

Then, as shown in FIG. 4(H), the CPU 21 performs speech speed conversion processing (S18). In the speech speed conversion processing, the CPU 21 produces a sound signal $X_{18}$-n having a time length T3 (T3>T1'/2) by elongating, in the time axis direction, the sound signal $X_{17}$-n having the time length T1'/2 which is stored in the RAM 22 as the processing result of the shift processing. For a specific procedure of the speech speed conversion processing, refer to Patent document 2.

Then, as shown in FIG. 4(I), the CPU 21 performs LPF processing of attenuating the sound signal $X_{18}$-n in a band that is higher than or equal to the frequency fc1 and HPF processing of attenuating the sound signal $X_{18}$-n in a band that is lower than or equal to the frequency fc2, and employs a processing result as a sound signal $X_{19}$-n (S19).

Then, as shown in FIG. 4(J), the CPU 21 performs time length adjustment processing on the sound signal $X_{19}$-n (S20). In the time length adjustment processing, the CPU 21 cuts out a sound signal $X_{20}$-n having the above-mentioned time length T4 (T4<T3) from the sound signal $X_{19}$-n which is stored in the RAM 22 as the processing result of the LPF processing and HPF processing (step S18).

Then, as shown in FIG. 4(K), the CPU 21 performs overall level adjustment processing on the sound signal $X_{20}$-n (S21). In the overall level adjustment processing, the CPU 21 multiplies the whole of the sound signal $X_{20}$-n having the time length T4 which is stored in the RAM 22 as the processing result of the time length adjustment processing by a level adjustment correction coefficient P, and employs a multiplication result as a processing result of the overall level adjustment processing (sound signal $X_{21}$-n).

Then, the CPU 21 outputs the sound signal $X_{21}$-n (the processing result of the overall level adjustment processing) to the writing control unit 15 as a sound signal Z-n (S22) of a masking sound. The writing control unit 15 stores the sound signal Z-n which is output from the CPU 21 in the storage medium 30 which is inserted in the writing control unit 15.

Then, the CPU 21 judges whether or not all of the N kinds of sound signals X-n (n=1 to N) stored in the storage unit 13 have been acquired (S23). If a sound signal(s) X-n that has not been acquired yet remains in the storage unit 13 (S23: no), the CPU 21 returns to step S10. The CPU 21 acquires an unacquired sound signal X-n from the storage unit 13, writes it to the RAM 22, and performs the subsequent pieces of processing again. On the other hand, if all of the N kinds of sound signals X-n (n=1 to N) stored in the storage unit 13 have been acquired (S23: yes), the CPU 21 finishes the process.

The above-described embodiment provides the following advantages. In the embodiment, unlike in the technique disclosed in Patent document 1, processing of randomly rearranging a sound signal representing a human voice in units of an interval corresponding to one phoneme. Instead, in the embodiment, the series of pieces of processing from acquisition of a sound signal of a human voice to generation of a sound signal masking sound includes the superimposition processing (S13) and the shift and addition processing (S17). A reproduction sound of a sound signal that is obtained by the series of pieces of processing including the superimposition processing (S13) and the shift and addition processing (S17) does not cause a listener to feel uncomfortable while providing the same level of masking effect as a masking sound that is obtained by randomly rearranging a sound signal representing a human voice in units of an interval corresponding to one phoneme. As such, the embodiment can reduce the degree of a discomfort a person existing in the space B suffers while securing a high masking effect.

Modifications of Embodiment 1

Medications of the above-described first embodiment will be described below.

(1) In the above embodiment, one kind of sound signal X-n is acquired each time from the storage unit 13 and one kind of sound signal Z-n is generated from the one kind of sound signal X-n. However, it is possible to acquire R (2≤R≤N) kinds of sound signals X-n together from the storage unit 13, perform the pieces of processing of steps S11-S21 on each of the acquired R kinds of sound signals X-n, and employ, as a sound signal Z-n of a masking sound, a sound signal obtained by adding together R kinds of sound signals obtained as processing results. Even where plural speakers having different voice features exist in the space A, this embodiment can provide a high masking effect in the space B by broadly accommodating the plural speakers (2) The above embodiment may be modified so that a sound signal X-n acquired from the storage unit 13 is made a processing subject of the shift and addition processing (step S17) without performing any of the pieces of processing of steps S11-S16 and S18-S21 and a sound signal obtained by the shift and addition processing is employed a sound signal Z-n of a masking sound. The degree of a discomfort a person existing in the space B suffers can be reduced while a high masking effect is secure even if as in this embodiment a sound signal X-n obtained by performing only the shift and addition processing on a sound signal X-n of a human voice without performing the superimposition processing is used as a sound signal Z-n of a masking sound. It is also possible to make a sound signal X-n acquired from the storage unit 13 a processing subject of the superimposition processing (step S13) without performing any of the pieces of processing of steps S11, S12, and S14-S21 and employ, as a sound signal Z-n of a masking sound, a sound signal obtained by the superimposition processing. The degree of a discomfort a person existing in the space B suffers can be reduced while a high masking effect is secure even if as in this embodiment a sound signal obtained by performing only the superimposition processing on a sound signal X-n of a human voice without performing the shift and addition processing is used as a sound signal Z-n of a masking sound. Furthermore, a configuration is possible in which the superimposition processing (step S13) or the shift and addition processing (step S17) is skipped according to, for example, a manipulation performed on a manipulation unit (not shown).

(3) In the superimposition processing (step S13) of the above embodiment, the CPU 21 extracts a first-half sound signal having the time length T1'/2 and a second-half sound signal having the time length T1'/2 from a sound signal $X_{12}$-n having the time length T1' which is stored in the RAM 22. Then, the CPU 21 generates a sound signal $X_{13}$-n having the time length T1'/2 by superimposing these two sound signals on each other with their head positions and tail positions set so as to coincide with each other. However, the CPU 21 may generate a sound signal $X_{13}$-n having the time length T1'/2 by extracting two sound signals having the time length T1'/2 whose tail portion and head portion coexist with each other from a sound signal $X_{12}$-n stored in the RAM and superimposing these two sound signals on each other with their head positions and tail positions set so as to coincide with each other. Furthermore, the number of sound signals to be extracted from a sound signal $X_{12}$-n is not limited to two; three or more sound signals may be extracted and superimposed on each other. And the lengths of plural sound signals to be extracted from a sound signal $X_{12}$-n need not always the same. For example, the CPU 21 may generate a sound signal $X_{13}$-n by dividing a sound signal $X_{12}$-n having the time length T1' into a sound signal that is longer than T1'/2 by a time T5 (T5<T1'/2) and a sound signal that is shorter than T1'/2 by the time T5 and superimposing the two divisional sound signals on each other.

(4) In the shift and addition processing (step S17) of the above embodiment, two copies of a sound signal $X_{16}$-n are produced. However, the number M of copies of a sound signal $X_{16}$-n may be one or larger than or equal to three. Where the number M of copies of a sound signal $X_{16}$-n is plural, it is possible to generate random numbers that are unique to respective copy sound signals $Xa_{16}$-n, $Xb_{16}$-n, $Xc_{16}$-n, . . . and determine reference positions Pa, Pb, Pc, . . . using the generated random numbers. As a further alternative, it is possible to provide a table which contains data indicating plural reference positions Pa, Pb, Pc, . . . and select reference positions Pa, Pb, Pc, . . . for respective sound signals $Xa_{16}$-n, $Xb_{16}$-n, $Xc_{16}$-n, . . . from the table.

Figure 6:
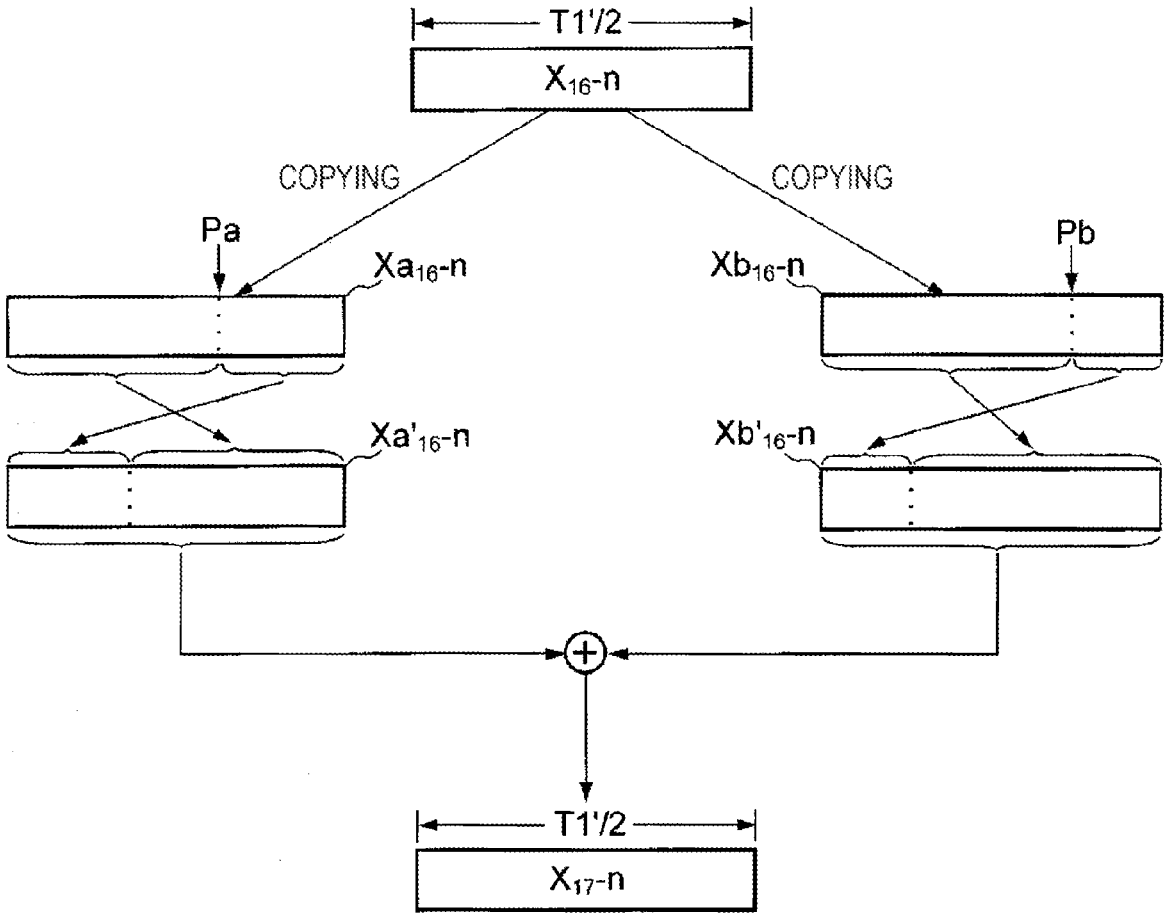
FIG. 6 illustrates the details of shift and addition processing which is performed by a masking sound generating apparatus according to another embodiment of the invention.

(5) In the shift and addition processing (step S17) of the above embodiment, the shift processing is performed on copies of a sound signal $X_{16}$-n and shift-processed sound signals and the original, non-shift-processed sound signal are added together. However, as shown in FIG. 6, it is possible to produce M' copies of a sound signal $X_{16}$-n (M': natural number that is larger than or equal to 2; for example, assume that M'=2), perform the above-described shift processing on each of only the M' (M'=2) copy sound signals $Xa_m$-n and $Xb_{16}$-n, and employ, as a processing result of the shift and addition processing, a sound signal obtained by adding together M' shift-processed sound signals $Xa_{16}$'-n and $Xb_{16}$'-n. This embodiment can also reduce the degree of a discomfort a person existing in the space B suffers while securing a high masking effect.

Figure 7:
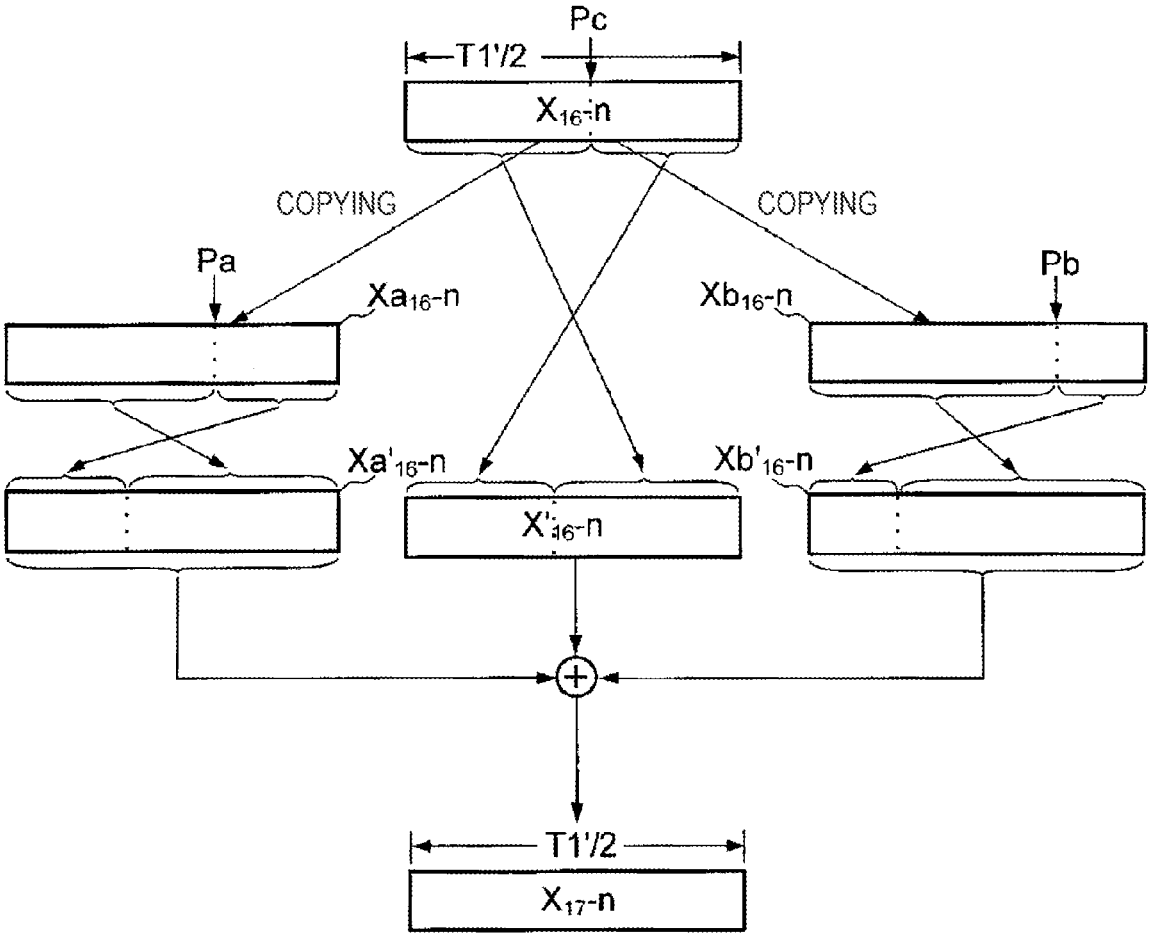
FIG. 7 illustrates the details of shift and addition processing which is performed by a masking sound generating apparatus according to a further embodiment of the invention.

(6) In the shift and addition processing (step S17) of the above embodiment, the shift processing is performed on copies of a sound signal $X_{16}$-n and shift-processed sound signals and the original, non-shift-processed sound signal are added together. However, as shown in FIG. 7, it is possible to produce M" copies of a sound signal $X_{16}$-n (M": natural number that is larger than or equal to 1; for example, assume that M"=2), perform the above-described shift processing on each of (M+1) sound signals $X_{16}$-n, $Xa_m$-n, and $Xb_{16}$-n including the original sound signal $X_{16}$-n and the M" (M"=2) copy sound signals $Xa_m$-n and $Xb_{16}$-n, and employ, as a processing result of the shift and addition processing, a sound signal obtained by adding together (M"+1) shift-processed sound signals $X_{16}$'-n, $Xa_{16}$'-n, and $Xb_{16}$'-n. This embodiment can also reduce the degree of a discomfort a person existing in the space B suffers while securing a high masking effect.

(7) In the reversing processing (step S14) of the above embodiment, a sound signal $X_{13}$-n as a processing result of the superimposition processing is divided into sound signals in plural intervals and the arrangement order of the divisional sound signal in each interval is reversed on the time axis. However, the arrangement order of the whole of a sound signal $X_{13}$-n may be reversed on the time axis without dividing the sound signal $X_{13}$-n into sound signals in plural intervals. In this case, it is appropriate to omit the normalization processing (step S15) and the cross-fade combining processing (step S16).

In the above embodiment, the reversing processing (S14), the normalization processing (S15), the cross-fade combining processing (S16), and the shift and addition processing (S17) are performed in this order. However, as described below in a second embodiment, the above embodiment may be modified so that they are performed in order of the shift and addition processing (S17), normalization processing (S15), the reversing processing (S14), and the cross-fade combining processing (S16).

Embodiment 2

Figure 8:
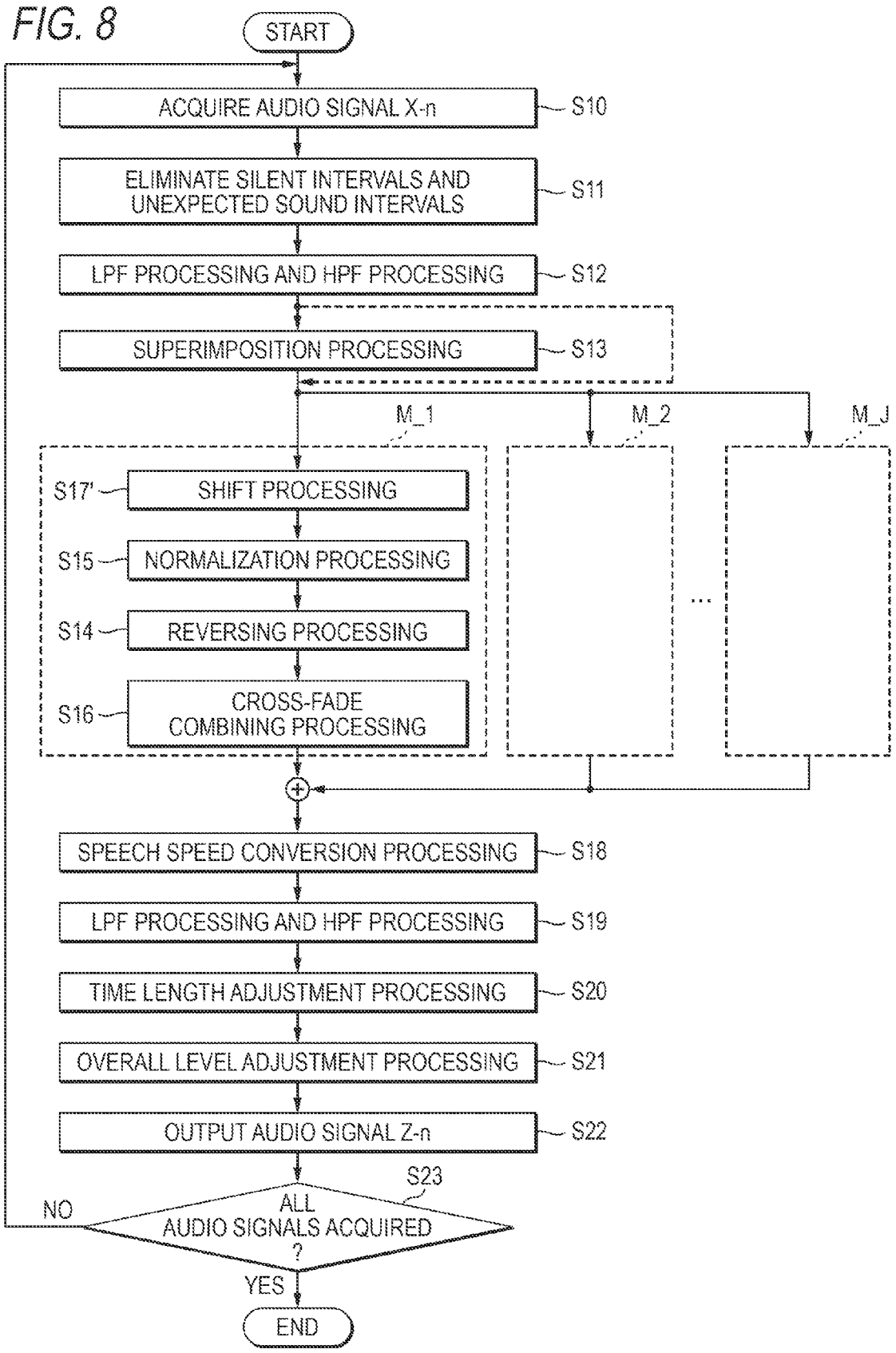
FIG. 8 is a flowchart showing how a masking sound generating apparatus according to a second embodiment of the invention operates.

FIG. 8 is a flowchart showing how a masking sound generating apparatus according to a second embodiment of the invention operates. In this flowchart, steps having corresponding steps in the first embodiment (see FIG. 2) are given the same step numbers Sxx as the latter.

In the first embodiment, as shown in FIG. 2, the masking sound generation program 24 includes the superimposition processing (S13) and the shift and addition processing (S17). Each of these pieces of processing is processing which extracts sound signal sequences in different intervals of a processing subject sound signal sequence and superimposes them on each other on the time axis, and has an effect of generating a sound signal sequence in which the order of phonemes in each of the different intervals basically remains the same as in the original sound signal sequence though the generated sound signal sequence is, as a whole, a disturbed version of the original sound signal sequence. A first difference between this embodiment and the first embodiment is that in this embodiment arrangements are made so that the superimposition processing (S13) can be skipped according to, for example, a manipulation performed on the manipulation unit.

If the superimposition processing (S13) is not skipped, a sound signal sequence which is made half, in time length, of a sound signal sequence produced by the LPF processing and HPF processing (step S12) by the superimposition processing (S13) is made a processing subject of pieces of macro processing M_1 to M_J shown in FIG. 8. If the superimposition processing (S13) is skipped, a sound signal sequence obtained by the LPF processing and HPF processing (step S12) is made a processing subject of the pieces of macro processing M_1 to M_J shown in FIG. 8.

A masking sound signal generated in this embodiment has a cycle that depends on the length of a sound signal sequence as a processing subject of the pieces of macro processing M_1 to M_J shown in FIG. 8. To prevent a listener from feeling uncomfortable, it is preferable that a generated masking sound signal have a long cycle. To this end, it is preferable that a sound signal X-n which is a source of a masking sound signal be a long duration. However, there may occur a case that it is difficult to set a long recording time and the duration of a sound signal X-n to be used for generation of a masking sound signal becomes short. In such a case, execution of the superimposition processing (S13) is not preferable because the cycle of a generated masking sound signal is shorter than before the execution. In view of this, in the embodiment, when the duration of a sound signal X-n to be used for generation of a masking sound signal is short, the superimposition processing (S13) is skipped to prevent shortening of the cycle of a masking sound signal.

Where the superimposition processing (S13) is skipped, one unit for disturbing a sound signal sequence is lost. However, in this embodiment, the shift processing (S17') which is part of the shift and addition processing (S17) of the first embodiment is performed in each piece of macro processing M_1 to M_J and a masking sound signal is generated from the sum of results of the pieces of macro processing M_1 to M_J. The pieces of macro processing M_1 to M_J and the processing of adding their processing results together have a role of disturbing a sound signal sequence. Therefore, a masking sound that does not cause a discomfort can be generated even if the superimposition processing (S17) is skipped.

A second difference between this embodiment and the first embodiment is that in this embodiment arrangements are made so that (J−1) copies of a sound signal sequence that is a result of the superimposition processing (S13) or a sound signal sequence that is a result of the LPF processing and HPF processing (S12) (the superimposition processing is skipped) are produced, the pieces of macro processing M_1 to M_J are performed using J sound signal sequences consisting of the original and the copies, respectively, and a sound signal sequence obtained by superimposing J processing result sound signal sequences on each other on the time axis is passed to the speech speed conversion processing (S18). In each of the pieces of macro processing M_1 to M_J, the shift processing (S17'), the normalization processing (S15), the reversing processing (S14), and the cross-fade combining processing (S16) are performed sequentially. The number J of generated sound signal sequences and the number J of pieces of macro processing M_1 to M_J to be performed can be specified by a manipulation performed on the manipulation unit (not shown).

In the above first embodiment, the reversing processing (S14), the normalization processing (S15), the cross-fade combining processing (S16), and the shift and addition processing (S17) are performed in this order. In contrast, in this embodiment, in each of the pieces of macro processing M_1 to M_J, the shift processing (S17'), the normalization processing (S15), the reversing processing (S14), and the cross-fade combining processing (S16) are performed in this order. This is also a difference between this embodiment and the above first embodiment.

The shift processing (S17') is processing of interchanging a portion, before a reference position Pa, of a processing subject sound signal sequence and the other portion after the reference position. Unlike the shift and addition processing (S17) of the above first embodiment, the shift processing (S17') does not perform addition to the original sound signal sequence. The reason why the shift processing (S17'), rather than the shift and addition processing (S17), is performed in each of the pieces of macro processing M_1 to M_J is as follows. If the shift and addition processing (S17) were performed in each of the pieces of macro processing M_1 to M_J, a sound signal sequence obtained by each piece of shift and addition processing (S17) should contain a component of the original sound signal sequence. Therefore, when processing results of the pieces of macro processing M_1 to M_J are added together, a sense of repetition of the original sound signal sequence should be emphasized. To prevent such an event, the shift processing (S17') which does not perform addition to the original sound signal sequence is performed in each of the pieces of macro processing M_1 to M_J.

In the embodiment, the reference position Pa used in the shift processing (S17') is varied among the pieces of macro processing M_1 to M_J. Therefore, the pieces of shift processing (S17') of the respective pieces of macro processing M_1 to M_J generate J sound signal sequences each of which is a phoneme sequence consisting of plural phonemes and in which the positions of the respective phonemes on the time axis are different from one sound signal sequence to another. In each of the J sound signal sequences obtained by the respective pieces of shift processing (S17'), although the positions of respective phonemes on the time axis are shifted from the positions of the corresponding phonemes in the original sound signal sequence, the order of the phonemes basically remains the same as in the original sound signal sequence. That is, in each of the J sound signal sequences obtained by the respective pieces of shift processing (S17'), the order of the phonemes remains the same as in the original sound signal sequence except that the last phoneme of the original sound signal is immediately followed by its head phoneme. Various kinds of means are conceivable as a unit for varying the reference position Pa from one piece of macro processing to another. In the embodiment, the reference positions Pa of the respective pieces of shift processing (S17') of the pieces of macro processing M_1 to M_J are set independently according to manipulations performed on the manipulation unit (not shown).

In each of the pieces of macro processing M_1 to M_J, the normalization processing (S15) is performed on the sound signal sequence obtained by the shift processing (S17'). In the normalization processing (S15), the processing subject sound signal sequence is divided into parts in plural intervals in such a manner that adjoining intervals overlap with each other by a fixed time t, in the same manner as in the reversing processing (S14) of the above first embodiment. In the normalization processing (S15), normalization is performed which calculates, for the respective intervals, correction coefficients for making sound signal effective values RMS of the respective intervals constant and multiplies the sound signals in the respective intervals by the correction coefficients calculated for the respective intervals. The calculation method of the normalization is basically the same as in the above first embodiment. However, in this embodiment, to prevent excessive normalization, the correction coefficients are multiplied by a certain moderation coefficient and final correction coefficients are restricted so as to fall within a range that is defined by a predetermined upper limit value and lower limit value.

In the embodiment, the boundaries to be used in dividing a processing subject sound signal sequence into parts in plural intervals in the normalization processing (S15) are set different from each other from one piece of macro processing to another. More specifically, in the embodiment, in the pieces of normalization processing (S15) of the respective pieces of macro processing M_1 to M_J, the one-interval lengths (or the number of intervals) of the division of a sound signal sequence are set different from each other from one piece of macro processing to another. Various kinds of means are conceivable as a unit for setting the one-interval length (or the number of intervals) of the division of a sound signal sequence different from each other from one piece of macro processing to another. In the embodiment, the one-interval lengths (or the numbers of intervals) are set independently from one piece of macro processing to another according to manipulations performed on the manipulation unit (not shown).

In each of the pieces of macro processing M_1 to M_J, the reversing processing (S14) is performed on sound signal sequences that are processing results of the normalization processing (S15). In the reversing processing (S14), the arrangement order of sound signal samples in each of the plural intervals of the normalized sound signal sequence is reversed. Where the one-interval lengths of a sound signal sequence are varied from one piece of macro processing to another, in the pieces of reversing processing (S14) of the respective pieces of macro processing M_1 to M_J, the arrangement order of sound signal samples in an interval is reversed in such a manner that the interval length varies from one piece of macro processing to another.

In the embodiment, arrangements are made so that execution of the reversing processing (S14) can be prohibited in part (e.g., macro processing M_J) of the pieces of macro processing M_1 to M_J according to, for example, a manipulation performed on the manipulation unit. The prohibition of execution of part of the pieces of macro processing M_1 to M_J makes it possible to prevent occurrence of peculiar intonations in a finally generated sound signal.

In each of the pieces of macro processing M_1 to M_J, after the execution of the reversing processing (S14), the cross-fade combining processing (S16) is performed which connects, on the time axis, adjoining ones of the sound signal sequences in the respective intervals which are processing results of the reversing processing (S14) so as to produce an overlap of a fixed time t. Resulting sound signal sequences are processing results of the respective pieces of macro processing M_1 to M_J, and a sound signal sequence obtained by superimposing these sound signal sequences on each other on the time axis is made a processing subject of the speech speed conversion processing (S18).

The speech speed conversion processing (S18) and the pieces of processing to be performed subsequently are the same as those of the above first embodiment.

The embodiment has been described above in detail.

This embodiment provides the same advantages as the first embodiment. Furthermore, in this embodiment, the superimposition processing (S13) can be skipped and a desired number of (J) sound signal sequences are produced by copying a sound signal sequence that is a result of the superimposition processing (S13) of the LPF processing and HPF processing and then subjected to the pieces of macro processing M_1 to M_J. As a result, as exemplified below, the embodiment makes it possible to use the masking sound generating apparatus in different manners according to various situations.

a. The superimposition processing (S13) is performed if the duration of a sound signal as a source of a masking sound signal is relatively long, and is skipped if the duration is relatively short.

b. Where the superimposition processing (S13) is skipped, the number J of pieces of macro processing M_1 to M_J and the number J of sound signal sequences to be generated for the respective pieces of macro processing M_1 to M_J are increased to increase the number of phonemes to be contained in a masking sound signal of one cycle.

c. Where a final masking sound is generated using a signal obtained by adding together masking sound signals obtained from sound signals of plural persons, the number J of pieces of macro processing M_1 to M_J and the number J of sound signal sequences to be generated for the respective pieces of macro processing M_1 to M_J may be decreased. In this case, the superimposition processing (S13) may be skipped.

d. Where a masking sound signal generated from a sound signal of one person is output as a masking sound, it is preferable not to skip the superimposition processing (S13). Where the duration of a sound signal to be used for generation of a masking sound signal is short and the superimposition processing (S13) is skipped, it is preferable to increase the number J of pieces of macro processing M_1 to M_J and the number J of sound signal sequences to be generated for the respective pieces of macro processing M_1 to M_J.

Modifications of Embodiment 2

The same modifications as of the above first embodiment are also possible for the second embodiment. Other modifications that are specific to the second embodiment are as follows.

(1) The number J of pieces of macro processing M_1 to M_J and the number J of sound signal sequences to be generated as processing subjects of the respective pieces of macro processing M_1 to M_J may be a predetermined number rather than a number that is determined according to a manipulation performed on the manipulation unit.

(2) It is possible to store, in the masking sound generating apparatus, a table in which information indicating whether to skip the superimposition processing (S13) and numbers J of pieces of macro processing M_1 to M_J and sound signal sequences to be generated as processing subjects of the respective pieces of macro processing M_1 to M_J are correlated with such parameters as the number of persons who provide sound signals as sources of masking sound signals and a sound signal recording time per sound signal providing person and to determine the number J automatically according to values of the parameters and the table.

(3) The reference positions Pa to be used in the respective pieces of shift processing (S17') of the pieces of macro processing M_1 to M_J may be determined by the masking sound generating apparatus itself rather than determined according to manipulations performed on the manipulation unit. One example method is to determine J boundary positions that divide a sound signal sequence into (J+1) equal parts and employ these boundary positions as reference positions Pa for the respective pieces of shift processing (S17') of the pieces of macro processing M_1 to M_J. Another example method is to determine J boundary positions that divide a sound signal sequence into J equal parts and employ these boundary positions and the head position of a sound signal sequence as reference positions Pa for the respective pieces of shift processing (S17') of the pieces of macro processing M_1 to M_J. When a reference position Pa is located at the head position, the whole sound signal sequence exists after the reference position Pa and nothing exists before it. Therefore, the same sound signal sequence as an original sound signal sequence is obtained when the portions before and after the reference position Pa are interchanged.

(4) In the normalization processing (S15) of each of the pieces of macro processing M_1 to M_J, the number of intervals of the division of a sound signal sequence may be determined by the masking sound generating apparatus itself rather than determined according to a manipulation performed on the manipulation unit. One example method is to prepare a sequence obtained by arranging numbers prime to each other in ascending order, select J highest-rank numbers from the sequence, and employ these numbers as the numbers of intervals of the division of a sound signal sequence in the normalization processing (S15) of each of the pieces of macro processing M_1 to M_J.

(5) The masking sound generating apparatus may be configured so that it always does not perform the superimposition processing (S13).

(6) In the second embodiment, both of the reference position Pa used in the shift processing (S17') and the boundaries between plural intervals of a sound signal sequence in the normalization processing (S15) (and the reversing processing (S14)) are set different from one macro processing to another. Alternatively, only one of the reference position Pa and the boundaries may be set different from one macro processing to another.

(7) In the second embodiment, the boundaries between plural intervals of a sound signal sequence in the normalization processing (S15) (and the reversing processing (S14)) are set different from one macro processing to another by making the length of intervals (or the number of intervals) of the division of a sound signal sequence different from each other from one macro processing to another. Alternatively, only the positions of the boundaries between intervals may be made different from each other from one macro processing to another whereas the length of intervals (or the number of intervals) of the division of a sound signal sequence is kept the same.

(8) Although in the second embodiment the J pieces of macro processing M_1 to M_J are performed parallel, they may be performed sequentially in order of, for example, the macro processing M_1, the macro processing M_2, . . . . That is, in the invention, plural shifting units (the pieces of shift processing (S17') of the J respective pieces of macro processing M_1 to M_J) need not always operate simultaneously in parallel, and may operate sequentially. The same is true of plural reversing units (the pieces of reversing processing (S14) of the J respective pieces of macro processing M_1 to M_J).

(9) In the second embodiment, the superimposition processing (S13) can be skipped. An alternative configuration is possible in which the superimposition processing (S13) and the shift processing (S17') of each of the J respective pieces of macro processing M_1 to M_J is skipped according to a manipulation performed on the manipulation unit.

Modifications Applicable to Both of Embodiment 1 and Embodiment 2

(1) The program which is run by the masking sound generating apparatus according to each of the above embodiments can be provided being recorded in a computer-readable recording medium such as a magnetic recording medium (e.g., magnetic tape or magnetic disk (HDD or FD)), an optical recording medium (e.g., optical disc (CD or DVD)), a magneto-optical recording medium, or a semiconductor memory. This program can be downloaded over a network such as the Internet.

(2) It is possible to record masking sound signals generated by the masking sound generating apparatus according to each of the above embodiments in a recording medium and to reproduce, for sound masking, a masking sound signal recorded in the recording medium at a distant place that is geographically distant from the masking sound generating apparatus. In this case, masking sound signals may be recorded in any kind of recording medium, that is, any of various kinds of computer-readable recording media such as a magnetic recording medium (e.g., magnetic tape or magnetic disk (HDD or FD)), an optical recording medium (e.g., optical disc (CD or DVD)), a magneto-optical recording medium, and a semiconductor memory. A file of such masking sound signals can be downloaded over a network such as the Internet.

The present application is based on Japanese Patent Application No. 2010-262250 filed on Nov. 25, 2010, Japanese Patent Application No. 2011-044873 filed on Mar. 2, 2011, and Japanese Patent Application No. 2011-252833 filed on Nov. 18, 2011, the disclosures of which are incorporated herein by reference.

INDUSTRIAL APPLICABILITY

The masking sound generating apparatus according to the invention can reduce, while securing a high masking effect in a space to which a masking sound is emitted, the degree of a discomfort a person existing in the space suffers.

DESCRIPTION OF REFERENCE NUMERALS AND SIGNS

10 . . . Masking sound generating apparatus; 11 . . . Microphone; 12 . . . A/D conversion unit; 13 . . . Storage unit; 14 . . . Control unit; 15 . . . Writing control unit; 21 . . . CPU; 22 . . . RAM; 23 . . . ROM; 24 . . . Masking sound generation program; 30 . . . Storage medium; 50 . . . Masking sound reproducing apparatus; 51 . . . Screen; 52 . . . Speaker.

The invention claimed is:

1. A masking sound generating apparatus comprising:

an acquiring unit for acquiring a sound signal sequence Xacq which represents a speech; and a generating unit that includes:

a superimposing unit for:

extracting plural sound signal sequences in different intervals of a subject sound signal sequence Xsubj, the subject sound signal sequence Xsubj based on the acquired sound signal sequence Xacq, and superimposing the extracted sound signal sequences on each other on the time axis into a superimposed sound signal sequence Xsuperimp such that the order of phonemes in each of the different intervals remains the same as in the acquired sound signal sequence Xacq, wherein the generating unit is provided for generating a masking sound signal based on the superimposed sound signal sequence Xsuperimp.

2. The masking sound generating apparatus according to claim 1, wherein the superimposing unit includes:

a shifting and adding unit for:

performing shift processing which is processing of interchanging a sound signal sequence before a reference position in a processing subject sound signal sequence Xshiftaddsubj and a sound signal sequence after the reference position in the processing subject sound signal sequence Xshiftaddsubj, resulting in a shift-processed sound signal sequence Xshiftproc, and outputting a sound signal sequence Xshiftaddout obtained by adding together the shift-processed sound signal sequence Xshiftproc and the original, non-shift-processed sound signal sequence Xshiftaddsubj.

3. The masking sound generating apparatus according to claim 1, wherein the superimposing unit includes:

a shifting and adding unit for:

performing plural pieces of shift processing which are pieces of processing of interchanging sound signal sequences before different reference positions in a processing subject sound signal sequence Xshiftaddsubj and sound signal sequences after the reference positions in the processing subject sound signal sequence Xshiftaddsubj, resulting in plural shift-processed sound signal sequences, respectively, and outputting a sound signal sequence Xshiftaddout obtained by adding together the plural shift-processed sound signal sequences obtained by the plural pieces of shift processing.

4. The masking sound generating apparatus according to claim 2, wherein the superimposing unit includes:

a dividing and adding unit for:

dividing, on the time axis, a processing subject sound signal sequence Xdivaddsubj into divided sound signal sequences having shorter time lengths and adding together the divided sound signal sequences, wherein the superimposing unit is provided for outputting a sound signal sequence obtained through pieces of processing by the dividing and adding unit and the shifting and adding unit.

5. The masking sound generating apparatus according to claim 2, wherein the superimposing unit includes:

a reversing unit for:

dividing a processing subject sound signal sequence Xrevsubj into sound signals in plural divisional intervals on the time axis, reversing the arrangement order of the sound signal in each divisional interval, and generating an arrangement-order-reversed sound signal sequence Xreversed, wherein the superimposing unit is provided for employing, as the processing subject sound signal sequence Xshiftaddsubj of the shifting and adding unit, a sound signal sequence based on the arrangement-order-reversed sound signal sequence Xreversed obtained through processing by the reversing unit.

6. The masking sound generating apparatus according to claim 2, wherein the superimposing unit includes:

a reversing unit for:

dividing a processing subject sound signal sequence Xrevsubj into sound signals in plural divisional intervals on the time axis, reversing the arrangement order of the sound signal in each divisional interval, and generating an arrangement-order-reversed sound signal sequence Xreversed, wherein the superimposing unit is provided for outputting a sound signal sequence obtained through pieces of processing by the shifting and adding unit and the reversing unit.

7. The masking sound generating apparatus according to claim 1, wherein the superimposing unit includes:

a dividing and adding unit for:

dividing on the time axis, a processing subject sound signal sequence Xdivaddsubj into divided sound signal sequences having shorter time lengths and adding together the divided sound signal sequences;

plural shifting units for performing pieces of shift processing which are pieces of processing of interchanging sound signal sequences before different reference positions in a sound signal sequence Xshiftsubj, obtained through processing by the dividing and adding unit and sound signal sequences after the reference positions in the sound signal sequence Xshiftsubj, resulting in plural shift-processed sound signal sequences, respectively; and an adding unit that adds together sound signal sequences based on the plural shift-processed sound signal sequences obtained through pieces of processing by the plural shifting units.

8. The masking sound generating apparatus according to claim 1, wherein the superimposing unit includes:

plural shifting units for performing pieces of shift processing which are pieces of processing of interchanging sound signal sequences before different reference positions in shift-processing subject sound signal sequences and sound signal sequences after the reference positions in the shift-processing subject sound signal sequences, respectively;

plural reversing unit for reversing, on the time axis, the arrangement order of a sound signal sequence in each divisional interval of plural divisional intervals of each reverse-processing subject sound signal sequence of plural reverse-processing subject sound signal sequences obtained through pieces of processing by the plural shifting units, and for generating arrangement-order-reversed sound signal sequences; and an adding unit for adding together sound signal sequences based on the arrangement-order-reversed sound signal sequences obtained through pieces of processing by the plural reversing units.

9. The masking sound generating apparatus according to claim 3, wherein the superimposing unit includes:

a dividing and adding that for:

dividing, on the time axis, a processing subject sound signal sequence Xdivaddsubj into divided sound signal sequences having shorter time lengths and adding together the divided sound signal sequences, and wherein the superimposing unit is provided for outputting a sound signal sequence obtained through pieces of processing by the dividing and adding unit and the shifting and adding unit.

10. The masking sound generating apparatus according to claim 3, wherein the superimposing unit includes:

a reversing unit for:

dividing a processing subject sound signal sequence Xrevsubj into sound signals in plural divisional intervals on the time axis, reversing the arrangement order of the sound signal in each divisional interval, and generating an arrangement-order-reversed sound signal sequence Xreversed;

wherein the superimposing unit is provided for employing, as the processing subject sound signal sequence Xshiftaddsubj of the shifting and adding unit a sound signal sequence based on the arrangement-order-reversed sound signal sequence Xreversed obtained through processing by the reversing unit.

11. The masking sound generating apparatus according to claim 3, wherein the superimposing unit includes:

a reversing unit for:

dividing a processing subject sound signal sequence Xrevsubj into sound signals in plural divisional intervals on the time axis, reversing the arrangement order of the sound signal in each divisional interval, and generating an arrangement-order-reversed sound signal sequence Xreversed;

wherein the superimposing unit is provided for outputting a sound signal sequence obtained through pieces of processing by the shifting and adding unit and the reversing unit.

12. A non-transitory recording medium stored with a masking sound signal that has output from the masking sound generating apparatus according to claim 1.

13. A masking sound reproducing apparatus for emitting a masking sound representing a masking sound signal that is output from the masking sound generating apparatus according to claim 1.

14. A non-transitory machine-readable medium containing a program for causing a computer to realize:

an acquiring unit for acquiring a sound signal sequence Xacq which represents a voice; and a generating unit that includes:

a superimposing unit for:

extracting plural sound signal sequences in different intervals of a subject sound signal sequence Xsubj, the subject sound signal sequence Xsubj based on the acquired sound signal sequence Xacq, and superimposing the extracted sound signal sequences on each other on the time axis into a superimposed sound signal sequence Xsuperimp such that the order of phonemes in each of the different intervals remains the same as in the acquired sound signal sequence Xacq, wherein the generating unit is provided for generating a masking sound signal based on the superimposed sound signal sequence Xsuperimp.

15. A masking sound generating apparatus comprising:

a non-transitory recording medium containing a program; and a processor that, when executing the program, is caused to perform:

acquiring a sound signal sequence Xacq which represents a speech;

extracting plural sound signal sequences in different intervals of a subject sound signal sequence Xsubj, the subject sound signal sequence Xsubj based on the acquired sound signal sequence Xacq;

superimposing the extracted sound signal sequences on each other on the time axis into a superimposed sound signal sequence Xsuperimp such that the order of phonemes in each of the different intervals remains the same as in the acquired sound signal sequence Xacq; and generating a masking sound signal based on the superimposed sound signal sequence Xsuperimp.

16. A non-transitory machine-readable medium containing a program for causing a computer to perform:

acquiring a sound signal sequence Xacq which represents a voice;

extracting plural sound signal sequences in different intervals of a subject sound signal sequence Xsubj, the subject sound signal sequence Xsubj based on the acquired sound signal sequence Xacq;

superimposing the extracted sound signal sequences on each other on the time axis into a superimposed sound signal sequence Xsuperimp such that the order of phonemes in each of the different intervals remains the same as in the acquired sound signal sequence Xacq; and generating a masking sound signal based on the superimposed sound signal sequence Xsuperimp.

* * * * *